United States Patent [19]

Sakurai et al.

[11] Patent Number: 4,472,657

[45] Date of Patent: Sep. 18, 1984

[54] SUPPORT FRAME FOR COLOR CATHODE-RAY TUBE

[75] Inventors: Yasuo Sakurai, Chiba; Kenichi Fukuzawa, Mobara, both of Japan

[73] Assignee: Hitachi, Ltd., Tokyo, Japan

[21] Appl. No.: 325,864

[22] Filed: Nov. 30, 1981

[30] Foreign Application Priority Data

Dec. 1, 1980 [JP] Japan ..... 55-170994[U]

[51] Int. Cl.[3] ..... H01J 29/80

[52] U.S. Cl. ..... 313/402; 313/404; 313/407; 313/479

[58] Field of Search ..... 313/402, 404, 407, 479

[56] References Cited

U.S. PATENT DOCUMENTS 3,873,874 3/1975 Shinal ..... 313/407

*Primary Examiner*—Eugene R. Laroche

*Assistant Examiner*—Robert E. Wise

*Attorney, Agent, or Firm*—Antonelli, Terry & Wands

[57] ABSTRACT

A support frame (10) of a cathode-ray tube for color television including a mask fixing section (10*a*) for affixing a shadow mask (2), an inner electron shield section (10*b*) extending from an end portion of the mask fixing section on the panel fluorescent surface side, and an outer electron shield section (10*e*) located on the panel skirt side as seen from an end portion of the mask fixing section on the panel seal surface side, the three sections (10*a*, 10*b*, 10*e*) being formed integrally with one another. The outer electron shield section includes a fold-back portion (10*c*) turned back from the panel seal surface side of the mask fixing section toward the panel fluorescent surface side, and a side wall portion (10*d*) extending from the fold-back portion along an inner surface of a panel skirt (1*c*).

2 Claims, 2 Drawing Figures

SUPPORT FRAME FOR COLOR CATHODE-RAY TUBE

BACKGROUND OF THE INVENTION (1) Field of the Invention

This invention relates to a support frame of a cathode-ray tube for color television including a support frame member for supporting a shadow mask and an electron shield member formed integrally with each other, and more particularly it is concerned with improvements in or relating to an outer electron shield section.

(2) Description of the Prior Art

A cathode-ray tube for color television equipped with this type of support frame is disclosed in U.S. Ser. No. 921,953 dated July 5, 1978 (Japanese patent application Laid-Open No. 130280/77 now abandoned. The construction disclosed therein is such that a shadow mask located on an inner surface of a panel is supported on an inner surface of a panel skirt through a spring. The shadow mask is reinforced as it is affixed to the support frame serving concurrently as an electron shield. The support frame comprises an inner electron shield section, a mask fixing section and an outer electron shield section. The arrangement whereby the support frame is formed with the inner and outer electron shield sections as a unit enables its strength to be increased. Thus the support frame formed of soft steel can have its thickness reduced to about 0.15–0.8 mm.

Meanwhile it is necessary that the support frame have its cross-sectional length increased as much as possible, and a side wall portion of the outer electron shield section extending along the panel skirt preferably has its length increased as much as possible so as to effectively provide a shield to an electron beam entering from outside the shadow mask. However, the position of the shadow mask may vary depending on the relation between the pitch of a triplet of red, green and blue stripes of a fluorescent screen and the pitch of an array of electron guns. If the side wall portion of the outer electron shield section sticks out of a panel seal surface, then difficulties are experienced in the production of cathode-ray tubes for color television. In view of these factors, it is impossible to lengthen the side wall portion sufficiently to effectively shield the electron beam. Particularly in a type of panel of low panel skirt, the length of the side wall portion becomes very small and it becomes impossible to effectively shield the electron beam while the rigidity of the support frame is reduced.

SUMMARY OF THE INVENTION

Accordingly this invention has as its object the provision of a support frame for a cathode-ray tube of color television capable of achieving satisfactory electron beam shield effects even if the panel has a very short skirt and having high rigidity.

According to the invention, there is provided a support frame of a cathode-ray tube for color television comprising at least a mask fixing section for affixing a shadow mask and an outer electron shield section formed on the panel skirt side with respect to an end portion of the mask fixing section on the panel seal surface side, the mask fixing section and the outer electron shield section being formed integrally with each other, wherein the improvement resides in that said outer electron shield section comprises a fold-back portion folded back from an end portion of the mask fixing section on the panel seal surface side toward the panel fluorescent surface side, and a side wall portion extending from the fold-back portion along an inner surface of a panel shirt.

DESCRIPTION OF THE PREFERRED EMBODIMENT

Figure 1:
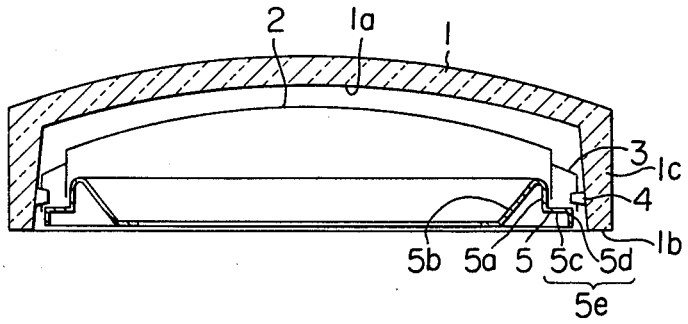
FIG. 1 PRIOR ART
FIG. 1 is a sectional view of a cathode-ray tube for color television of the prior art.

FIG. 1 shows a cathode-ray tube for color television of the prior art including a panel 1, and a shadow mask 2 made of metal spaced apart a predetermined distance from the panel 1 and supported by panel pins 4 on the inner surfaces of a skirt 1*c* of the panel 1 through springs 3. The shadow mask 2 is reinforced by being affixed to a support frame 5 made of soft steel which serves concurrently as an electron shield. The support frame 5 comprises a mask fixing section 5*a* to which the shadow mask 2 is affixed, an inner electron shield section 5*b* extending from an end portion of the mask fixing section 5*a* on the panel fluorescent surface 1*a* side and inwardly tilting, and an outer electron shield section 5*e* including a planar surface portion 5*c* extending from an end portion of the mask fixing section 5*a* on the panel seal surface 1*b* side toward an inner surface of the panel skirt 1*c* substantially perpendicularly thereto and a side wall portion 5*d* extending from an end portion of the planar portion 5*c* along the inner surface of the skirt 1*c* toward a panel seal surface 1*b*. By forming the support frame 5 integrally with the electron shields 5*b* and 5*e*, it is possible to increase the strength of the support frame 5, so that the support frame 5 made of soft steel can have its thickness reduced to about 0.15–0.8 mm. However, the outer electron shield section 5*e* and its side wall portion 5*d* have disadvantages in that the cross-sectional length of the former and the length of the latter are not enough to enable the outer electron shield section 5*e* to provide a satisfactory electron shield and to permit high rigidity to be given to the frame 5.

Figure 2:
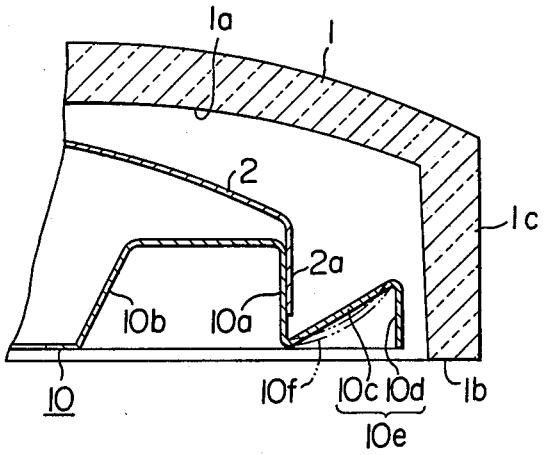
FIG. 2 is a sectional view, on an enlarged scale, showing the essential portions of an embodiment of the support frame in conformity with the invention.

A preferred embodiment of the invention which obviates the aforesaid disadvantages of the prior art will now be described by referring to FIG. 2. A support frame 10 made of soft sheet steel is similar to the support frame 5 of the prior art in that it comprises a mask fixing section 10*a* to which a shadow mask 2 formed of metal plate is affixed, and an inner electron shield section 10*b* extending from an end portion of the mask fixing section 10*a* on the fluorescent surface 1*a* side substantially horizontally and inwardly tilting. The present invention is characterized in that an outer electron shield section 10*e* compises a fold-back portion 10*c* folded back from an end portion of the mask fixing section 10*a* on the panel seal surface 1*b* side toward the fluorescent surface 1*a* side, and a side wall portion 10*d* extending from the fold-back portion 10*c* along an inner surface of the panel skirt 1*c*.

The provision of the fold-back portion 10*c* enables the length of the side wall portion 10*d* to be increased, thereby permitting a satisfactory electron shield to be provided and allowing the rigidity of the support frame 10 to be increased. Also, the problem that a skirt 2*a* of the shadow mask 2 catches against the panel skirt 1*c* during assembling can be obviated. Since the mask fixing section 10 can be made to extend for a substantial distance on the panel seal surface 1*b* side, it is possible to increase the tolerance of the skirt 2*a* of the shadow mask 2. In the embodiment shown and described hereinabove, the fold-back portion 10*c* is in the form of an inclined planar surface. However, the invention is not limited to this specific form and that the fold-back portion 10*c* may be in the form of a curved surface as indicated by dot-and-dash lines in FIG. 2. This is conducive to increased rigidity of the support frame 10.

When the present invention was incorporated in a 14" diagonal type cathode-ray tube for color television, the spacing between the side wall portion 10*d* and the inner surface of the panel skirt 1*c* was 2.0 mm, and the side wall portion 10*d* had a length of 5.5 mm. In the support frame 5 of the prior art, the corresponding figures are 2.0 mm and 3.5 mm. Since the side wall portion 10*d* according to the invention is over 50% longer than the corresponding part of the prior art, it is possible to provide an increased electron shielding and to increase the rigidity of the support frame 10 by the present invention. Also, the invention can achieve the effects of providing better protection to the shadow mask and increasing the tolerance of the shadow mask in design.

What is claimed is:

1. A support frame of a cathode-ray tube for a color television comprising at least a mask fixing section for affixing to a shadow mask, and an outer electron shield section formed on a panel skirt side of an end portion of the mask fixing section on the panel seal surface side, the mask fixing section and the outer electron shield section being formed integrally with each other, with the outer electron shield being cantilevered from the end portion of the mask fixing section so as to have a side wall portion form a free end thereof that extends along a skirt of the panel in a direction toward a seal surface located on an end of the skirt of the panel, wherein the improvement resides in that:

said outer electron shield section comprises:

a fold-back portion folded back from the end portion of the mask fixing section in a direction toward a fluorescent surface side of the panel; and said side wall portion extending from the end fold-back portion along an inner surface of the panel skirt.

2. A support frame for a cathode-ray tube for color television as claimed in claim 1, wherein said fold-back portion is in the form of a curved surface.

* * * * *